United States Patent [19]

Foo

[11] 4,085,872

[45] Apr. 25, 1978

[54] SLING FOR TENNIS RACKET

[75] Inventor: Kenneth Foo, New York, N.Y.

[73] Assignee: Theodore Gottlieb, New York, N.Y.

[21] Appl. No.: 669,708

[22] Filed: Mar. 23, 1976

[51] Int. Cl.[2] ..... A41D 27/20; B65D 85/00

[52] U.S. Cl. ..... 224/5 D; 2/250; 206/315 B; 224/23

[58] Field of Search ..... 224/5 D, 1 A, 1 R, 22–24, 224/45 L, 5 MC, 14; 206/315 B, 315 R; 2/250; 24/3 F, 73 AS; 128/513

[56] References Cited

U.S. PATENT DOCUMENTS

| | | | |
|---|---|---|---|
| 745,866 | 12/1903 | Laing | 224/1 R |
| 2,102,964 | 12/1937 | Mossberg | 224/1 A X |
| 2,416,641 | 2/1947 | Pocock | 224/23 |
| 2,684,097 | 7/1954 | Treul | 224/5 T |
| 3,319,852 | 5/1967 | Perkins | 224/1 A |
| 3,716,016 | 2/1973 | Aylesworth et al. | 273/32 D X |
| 3,963,157 | 6/1976 | Truax et al. | 224/5 D |

FOREIGN PATENT DOCUMENTS

| | | | |
|---|---|---|---|
| 16,896 of | 1905 | United Kingdom | 273/32 D |

*Primary Examiner*—Drayton E. Hoffman
*Assistant Examiner*—Carl Rowold
*Attorney, Agent, or Firm*—Howard Myles Schwinger

[57] ABSTRACT

A sling for carrying a tennis racket consisting of an elastic strap adapted to extend diagonally from the shoulder to the opposite hip of the wearer. The strap is looped at one end for engaging receiving the handle end of the racket and has means at its other end for engaging the other end of the racket.

4 Claims, 4 Drawing Figures

SLING FOR TENNIS RACKET

INTRODUCTION

This invention relates to a means for conveniently carrying a tennis racket upon the person when traveling on foot and it is the primary object of the invention to provide such a device which by nature is inexpensive and attractive and which ideally carries out its intended purpose.

Although many proposals have been put forth to accomplish this purpose, none has utilized the approach presented by this invention. An embodiment of the invention is illustrated by the accompanying drawing.

THE DRAWING

DESCRIPTION OF THE INVENTION

The device essentially consists of a strap 10 which is affixed at one end to the handle 12 and at the other end to the frame 14 of a tennis racket.

In this embodiment, strap 10 is of a woven fabric which has been folded upon itself and transversely stitched together at 16, 18 and various other locations to present a double layered structure.

The composition of the strap is not critical, the only requirement being that of elasticity. Hence the strap may be of a plastic composition.

Figure 2:
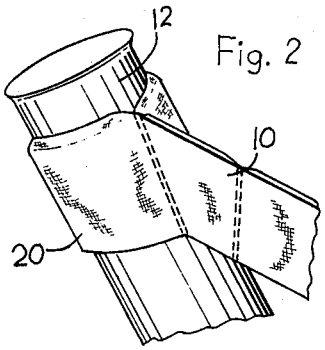
FIG. 2 is a fragmentary view of one end of the device.

Loops 20 and 22 are formed at either end of the strap, by stitching in this instance. Loop 20 is dimensioned to receive the handle end 12 of the racket, as may be seen in FIG. 2. The handle end is actually forced into loop 20 which expands to receive it and whose inner wall grips the handle in tight engagement.

Loop 22, at the other end of the strap, is to house tie 24 by means of which the strap may be fastened to the other end of the racket.

By suitably stitching the layers together, compartments such as 26 and 28 may be formed and used to carry articles such as balls and loose change. Compartment 26 is open on both sides and dimensioned to clampingly engage ball 30, as shown. The diamond shaped arrangement of compartment 28 is for loose change being designed to retain the change therein.

Figure 1:
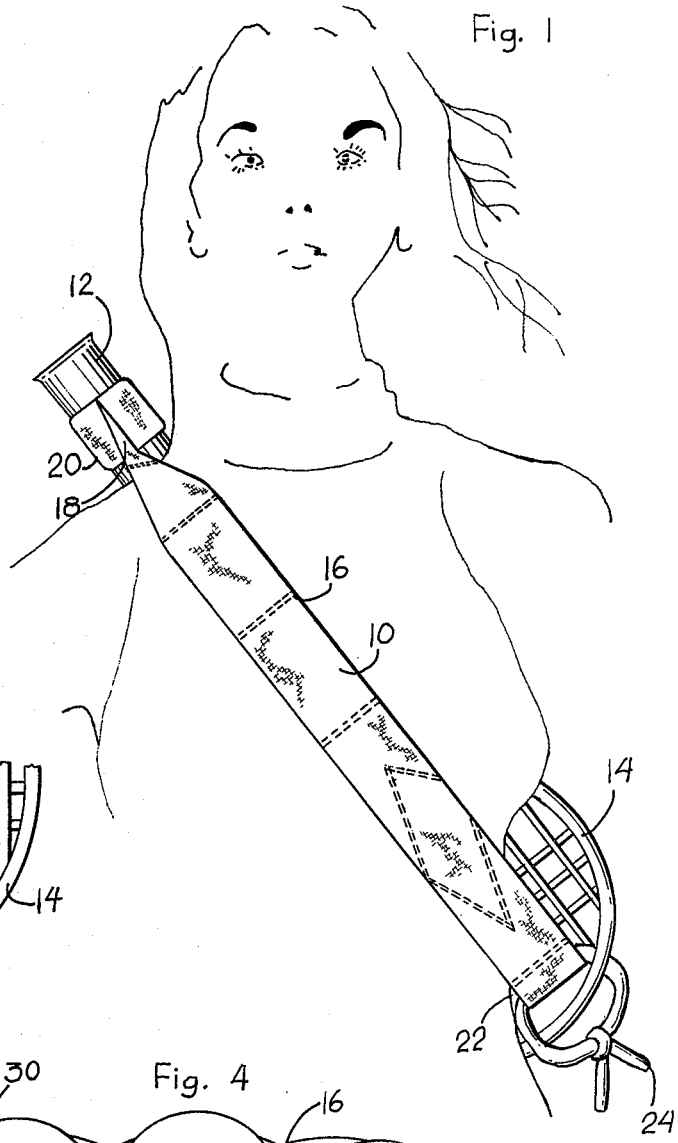
FIG. 1 shows the device actually in use.
Figure 3:
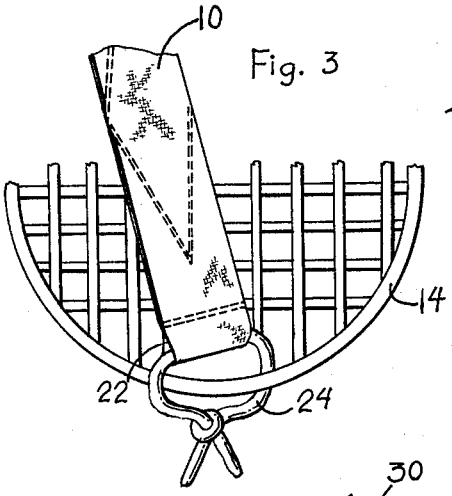
FIG. 3 is a similar view of the other end.
Figure 4:
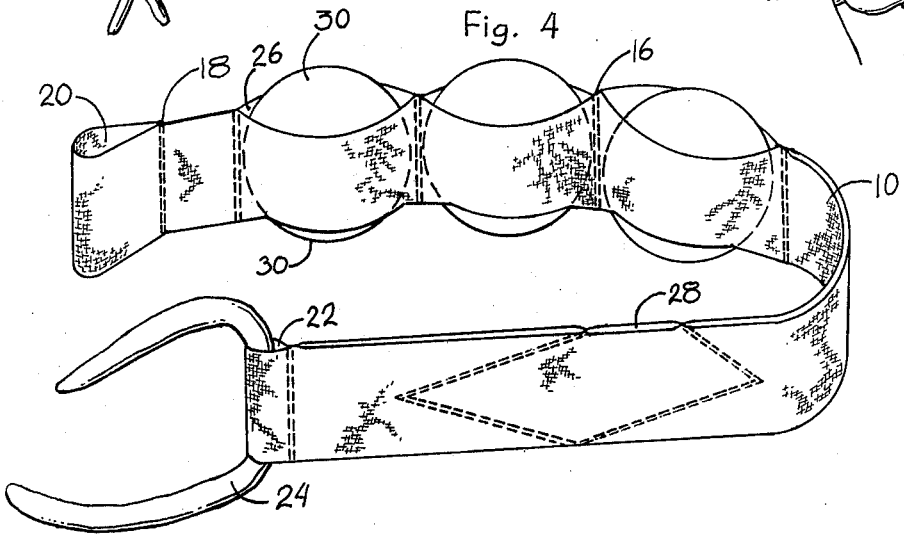
FIG. 4 is a perspective view of the device of FIG. 1.

When strap 10 is affixed to the racket in accordance with the foregoing, the assemblage may be readily slung across the body, as shown in FIG. 1, and conveniently carried. In the embodiment of FIG. 1 the racket is carried on the back as this would appear more preferable than carrying it across the chest but the mode of wearing the assemblage is a matter of individual preference. It is to be noted that strap 10 is designed to extend from the shoulder to the opposite hip.

Although a tennis racket is shown and described herein, this is done by way of example only as the invention may be employed to carry squash or badminton rackets or any racket of a size which may be conveniently slung across the body.

I claim:

1. A carrier for a tennis racket comprising a continuous band of elastic fabric dimensioned to extend diagonally across one side of the upper body of the user, from shoulder to opposite hip; the continuous band being transversely interconnected at two distant locations to provide pocketed ends, one pocket being larger than the other; the larger pocket of the size to clampingly receive the grip of the racket; the smaller pocket to house means for affixing the band to the racket frame; the racket when thus affixed to the band forming a half rigid, half elastic structure which can be diagonally clamped across the body as aforesaid.

2. The band of claim 1 having a plurality of pockets formed by transverse connections in the carrier to hold balls, money and the like.

3. The band of claim 2 wherein the affixing means is a tie cord.

4. A carrier for a tennis racket comprising a strap dimensioned to extend diagonally across one side of the upper body of the user, from shoulder to opposite hip; said strap forming loops at each end thereof; one loop being larger than the other; the larger loop being of elastic fabric and being sized to clampingly engage the grip of the racket; the smaller loop to house means for affixing the strap to the racket frame; the racket when thus affixed to its carrier forming a part rigid, part elastic structure which can be diagonally clamped across the body as aforesaid.

* * * * *